United States Patent [19]

Siemers et al.

[11] Patent Number: 5,042,710

[45] Date of Patent: Aug. 27, 1991

[54] METHOD OF FORMING FILAMENT REINFORCED SHAFT

[75] Inventors: Paul A. Siemers, Clifton Park; Stephen F. Rutkowski, Duanesburg, both of N.Y.

[73] Assignee: General Electric Company, Schenectady, N.Y.

[21] Appl. No.: 546,951

[22] Filed: Jul. 2, 1990

[51] Int. Cl.[5] ..... B23K 20/14

[52] U.S. Cl. ..... 228/172; 29/419.1; 228/190

[58] Field of Search ..... 228/190, 172; 29/419.1

[56] References Cited

U.S. PATENT DOCUMENTS

| | | | |
|---|---|---|---|
| 3,900,150 | 8/1975 | Delgrosso et al. | 29/419.1 X |
| 4,010,884 | 3/1977 | Rothman | 228/190 |
| 4,163,380 | 8/1979 | Masoner | 29/419.1 X |
| 4,805,833 | 2/1989 | Seimers | 29/419.1 X |
| 4,907,736 | 3/1990 | Doble | 228/190 |

*Primary Examiner*—Kenneth J. Ramsey

*Attorney, Agent, or Firm*—Paul E. Rochford; James C. Davis, Jr.; James Magee, Jr.

[57] ABSTRACT

A method for forming a shaft of filament reinforced matrix metal is provided. The hollow shaft structure is made up of a number of layers of monotape which are assembled together and then HIPed to form a consolidated composite tubular shaft structure. The monotapes employed in forming the individual layers are prepared by plasma spray deposition of matrix metal onto and around an aligned set of reinforcing filaments. Following the plasma spray deposition of the matrix metal, the upper portion of the metal is removed by grinding or machining to increase the density of the monotape by removing the lens dense upper layer. The monotapes are assembled into the hollow shaft configuration by wrapping onto a shaft shaped mandrel in successive layers wound at a pitch to the axis of the mandrel. Consolidation of the multilayer wound structure is accomplished by HIPing at at least 900° C. and at least 15 ksi for a period of more than 1 hour.

4 Claims, 2 Drawing Sheets

METHOD OF FORMING FILAMENT REINFORCED SHAFT

CROSS REFERENCE TO RELATED APPLICATIONS

The present invention relates closely to copending application Ser. No. 546,969, filed July 2, 1990, and to application Ser. No. 546,200 filed June 29, 1990. The texts of these related applications are incorporated herein by reference.

BACKGROUND OF THE INVENTION

The present invention relates generally to high strength, light weight shaft members and a method of fabrication. More particularly, it relates to filament reinforced composite structures in the form of shafts which shafts have very high strength in relation to the weight thereof.

The fabrication of filament reinforced composite structures having high strength ceramic fibers embedded within metal matrices are known.

The preparation of titanium alloy base foils, sheets, and similar articles and of reinforced structures in which silicon carbide fibers are embedded in a titanium base alloy are described in U.S. Pat. Nos. 4,775,547; 4,782,884; 4,786,566; 4,805,294; 4,805,833; and 4,838,337; assigned to the same assignee as the subject application. The texts of these patents are incorporated herein by reference. Preparation of composites as described in these patents is the subject of intense study inasmuch as the composites have very high strength properties in relation to their weight. One of the properties which is particularly desirable is the high tensile properties imparted to the structures by the high tensile properties of the silicon carbide fibers or filaments. The tensile properties of the structures are related to the rule of mixtures. According to this rule the proportion of the property, such as tensile property, which is attributed to the filament, as contrasted with the matrix, is determined by the volume percent of the filament present in the structure and by the tensile strength of the filament itself. Similarly, the proportion of the same tensile property which is attributed to the matrix is determined by the volume percent of the matrix present in the structure and the tensile strength of the matrix itself.

Prior to the development of the processes described in the above-referenced patents, such structures were prepared by sandwiching the reinforcing filaments between foils of titanium base alloy and pressing the stack of alternate layers of alloy and reinforcing filament until a composite structure was formed. However, that prior art practice was found to be less than satisfactory when attempts were made to form specific structures of novel shape in which the filament was an internal reinforcement for the entire structure.

One of the structures which was formed by use of the prior art foil and fiber technique described immediately above is a shaft structure. Because of the fiber reinforcement and the use of lighter weight matrix metal, such as titanium, and due to the design of the shaft as a hollow article, the shaft could be fabricated employing reinforced deposit metal with lighter weight and greater stiffness than was possible employing metal alone.

One of the difficulties encountered in forming such prior art hollow shaft members using the prior art foil and fiber technique was that the volume of empty space in the composite prior to consolidation was quite large and because of this larger portion of empty space in the precompacted composite a substantial movement of the material being compacted was necessary in order to achieve the desired full density of the consolidated article. In order to achieve such full density, the foil had to flow in between and essentially around the individual fibers as the consolidation took place as, for example, through HIPing. However, as explained more fully below, the preparation of such hollow shaft members through practice of the present invention, greatly minimizes or eliminates the amount of void space in the compacted structure and thus overcomes the problems associated with the need for substantial movement of the fiber and matrix material during consolidation.

The structures taught in the above-referenced patents and the methods by which they are formed, greatly improve over the earlier practice of forming sandwiches of matrix and reinforcing filament by compression.

Later it was found that while the structures prepared as described in the above-referenced patents have properties which are a great improvement over earlier structures, the attainment of the potentially very high ultimate tensile strength of these structures did not measure up to the values theoretically possible when certain metals were employed as the matrix material. The testing of composite formed according to the methods taught in the above patents has demonstrated that, when employing Ti1421 alloy, although modulus values are generally in good agreement with the rule of mixtures predictions, the ultimate tensile strength is usually much lower than predicted by the underlying properties of the individual ingredients to the composite. A number of applications have been filed which are directed toward overcoming the problem of lower than expected tensile properties and a number of these applications are copending. These include applications Ser. No. 445,203, filed Dec. 4 1989; Ser. No. 459,894, filed Jan. 2, 1990, now U.S. Pat. No. 4,978,585; and Ser. Nos. 455,041 and 455,048, both filed Dec. 22, 1989. The texts of these applications are incorporated herein by reference.

It has been discovered that a unique structure can be formed employing monotape strips of metal matrix strengthened by filamentary reinforcement. By the term "monotape" as used herein is meant a ribbon-like structure in which a single layer of filament reinforcement is embedded within a layer of matrix metal. These novel structures are formed by winding the monolayer strips as a ribbon about an elongated mandrel having the dimensions of a shaft. The ribbon is wound about the mandrel at an angular pitch such that the ribbon completely covers the shaft and the ribbon follows a spiral path along the length of the shaft. A single ribbon may be employed so that its opposite edges abut to form a spiral seam extending along the length of the shaft shaped mandrel. Alternatively, a plurality of composite ribbons can be wound on the shaft so that their edges abut along a spiral path and the surface of the mandrel is completely covered. The angle of the spiral relative to the axis of the shaft may be of the order of 15 to 30 degrees.

In order to provide additional strengthening of the structure, layers of composite ribbon are wound on the shaft shaped mandrel with each layer wound in a reverse pitch to the next underlayer. Once the several layers of composite ribbon are wound on the mandrel, the structure is consolidated by HIPing to combine the several layers into a single consolidated tubular structure.

BRIEF DESCRIPTION OF THE INVENTION

Accordingly, the first object of the present invention is to provide a method for forming a high strength, low weight shaft structure having filamentary reinforcement therein.

Another object is to provide a method of achieving high density in the matrix portion of a composite shaft having a combination of high strength and low weight.

A further object of the present invention is to provide a uniquely strong shaft element having a high strength and a relatively low weight.

Other objects and other advantages of the present invention will be in part apparent and in part pointed out in the description which follows.

In one of its broader aspects, objects of the present invention can be achieved by providing a shaft shaped mandrel and disposing layers of monotape thereon. The monotape is a layer of matrix metal containing a single planar set of parallel reinforcement strands disposed therein. The monotape is prepared by disposing an array of aligned reinforcing filaments on a substrate surface and plasma spray depositing matrix metal thereon and therearound to form a monolayer. Following the plasma spray deposition, the upper surface of the monolayer is abraded to remove less dense matrix and to thereby increase the density of the matrix and filament reinforcement which remains, as well as the volume fraction of filament in the monotape. At least one ribbon of monotape is wound on the mandrel so that the edges thereof abut and the mandrel is completely covered with the single layer of monotape. Additional layers of monotape are wound in a similar fashion on the mandrel. After a desired number of layers of monotape are wound, the structure is enclosed within a HIPing can and is HIPed at at least 800° C. and at least 5 ksi for a period in excess of 30 minutes.

BRIEF DESCRIPTION OF THE DRAWINGS

The detailed description of the invention which follows will be understood with greater clarity if reference is made to the accompanying drawings in which.

DETAILED DESCRIPTION OF THE INVENTION

Figure 1:
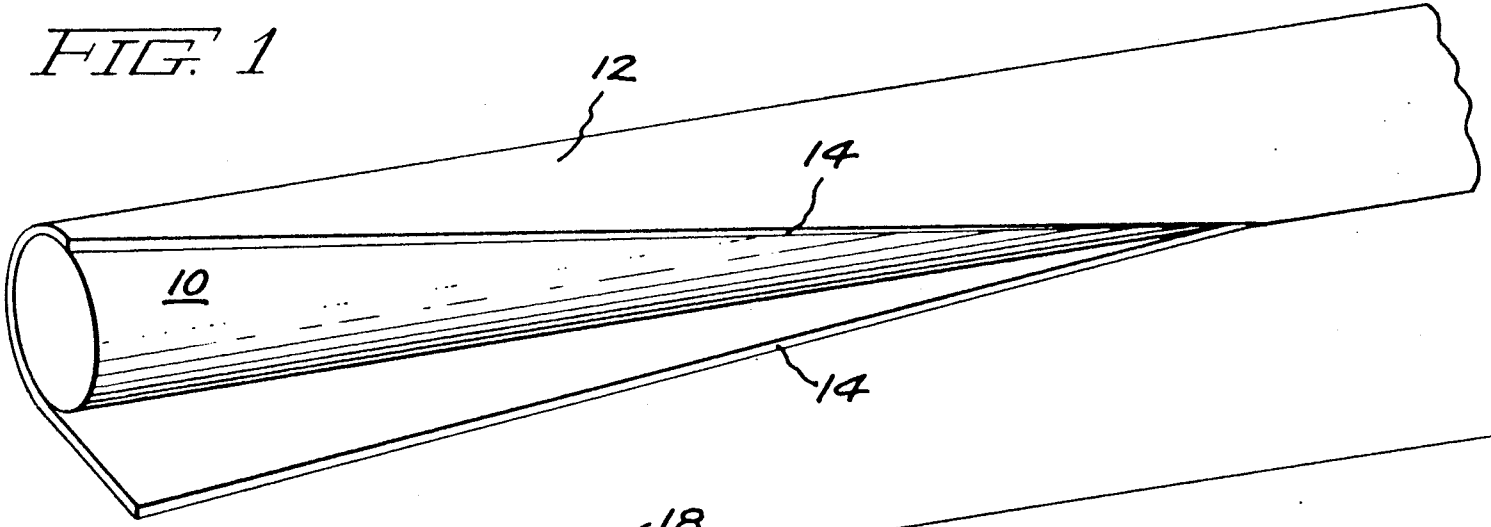
FIG. 1 is a semischematic isometric drawing in which a layer of monotape is shown being wound onto a mandrel.

The filament reinforcement which may be employed in reinforcing monotape structures may be any one of a number of such filaments. For example, commercially available filaments of aluminum oxide may be employed. Also, commercially available filaments of silicon carbide may be employed. One such filament is that prepared by the Textron Specialty Materials Company and is identified as SCS-6. It is a round filament of about 5.6 mils in diameter and indefinite length.

Such a filament may be prepared into a monotape by methods described in the patents referenced in the background statement of this application and particularly U.S. Pat. Nos. 4,782,884 and 4,786,566. Alternatively, such monotapes may be prepared by aligning the filamentary reinforcement and embedding the aligned filament in the matrix metal by other means. In carrying out the invention pursuant to the present invention it is preferred to employ silicon carbide fibers and to embed the fibers in matrix metal by r.f. plasma spray deposition as discussed and described in the background statement of this patents and in the applications referenced therein.

One such method of preparation involves the aligning of the filamentary reinforcement on a large diameter drum. Such a drum may be of the order of 3 feet in diameter to produce a monotape of 9 feet in length. The surface of the drum may be formed of or coated with a layer of molybdenum metal or other suitable refractory metal which acts as a release surface for release of titanium base alloy which is plasma spray deposited thereon.

Following the alignment of a layer of filamentary reinforcement on the surface of the drum at a filament density of over 100 turns per inch, the drum is introduced into a low pressure r.f. plasma spray chamber and the titanium base alloy, such as Ti-64 or Ti-6242, is plasma spray deposited thereon to form the monotape layer.

The drum and the monolayer formed thereon are removed from the chamber and the surface of the monotape is subjected to an abrading action to remove the less dense metal which forms at the upper surface of the monotape from the action of the plasma spray. For example, for a tape of about 25 mils approximately 8–10 mils can be removed by abrading or machining without removing a substantial amount of the metal of the monotape and without reaching the reinforcing filament. Approximately 10 to 50% of the monotape thickness can be usefully removed in this way although it is preferred to remove between 20 and 40 percent of the thickness of the as deposited matrix. This is because of the relatively lower density of the upper 10 mils of the monotape formed by plasma spray deposition.

With regard to the abrading of an r.f. plasma spray deposited titanium base alloy layer, it has been observed that the abrasive action quickly removes an upper portion of the deposit to reduce the thickness from about 25 mils to about 15 to 17 mils. This abrading of the upper less dense material occurs within a few minutes. In other words, what we have observed is that perhaps 90 to 95% of the less dense material is removed from the deposited layer by abrasion within the first five minutes. If the abrasive action is continued for another 30 minutes, the amount of thickness change of the layer is very minimal and may be zero to one mil of additional thickness. This is partly because the material which is removed is of an appreciably lower density than the material of the layer which remains after the first few minutes of abrading with an abrasive tool, such as a belt sander or with a similar abrasive action.

One of the advantages of the present method of forming shaft structures is that the monotape employed has a relatively small amount of voids. Accordingly, the consolidation of a number of layers of monotape does not require a very large movement, the reinforcing filament or of the matrix material during the consolidation. This contrasts with the situation which exists when such a shaft is made using the prior art foil and fiber technique. Because of the relatively large volume of initial voids in an assembly of foil and fiber to be consolidated, the number of layers of fiber which can be included in a shaft-type structure is relatively limited and may be of the order of 10 to 20 layers. By contrast, because of the larger density of the monotape as employed in practicing the present invention, shaft structures having 40 or 50 layers of reinforcement in a shaft structure can be prepared employed the teaching of the present invention. This difference from the prior art is very significant in the properties of the shaft structure which is produced.

Following the removal of the less dense portion of the monotape, the monotape itself is removed from the refractory metal surface of the drum. Such a monotape is a relatively flexible sheet-like structure which is then slit into ribbons of desired widths.

In order to form a shaft, the first step is to provide a shaft shaped mandrel such as 10 of FIG. 1. Such a mandrel is cylindrical in shape and has a diameter of about 1.5–4 inches and a length of about 3–6 feet. A ribbon 12 of monotape is then wound on the surface of the mandrel so that the ribbon seam 14 has a pitch of about 15° to the axis of the mandrel. The ribbon is of sufficient width that when properly wound on the mandrel, the edges thereof abut and a single ribbon is able to completely cover the surface of the mandrel.

Figure 2:
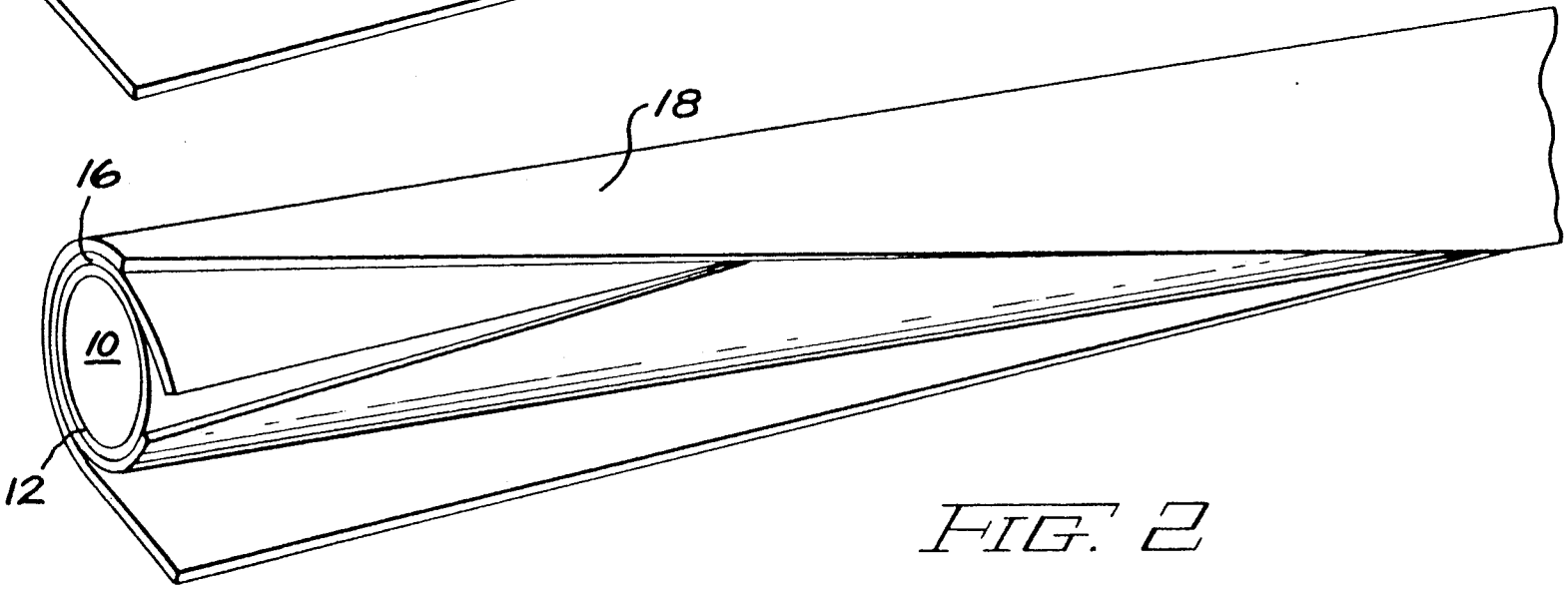
FIG. 2 is the wound mandrel of FIG. 1 having a second and third monotape wound with opposite pitch over the first layer of monotape.

A second ribbon 16 is then provided having a width very slightly greater than that of the first ribbon and it is wound over the first ribbon as illustrated in FIG. 2, again with the seam set at about 15° to the axis of the shaft of the mandrel, but with the pitch opposite to that of the first layer of monotape. A third monotape layer 18 is then wound over the second monotape layer 16 and again with a pitch opposite to that of the second layer of monotape 16. Such an arrangement of first, second and third layer ribbons with opposite pitch is illustrated in FIG. 2.

Figure 4:
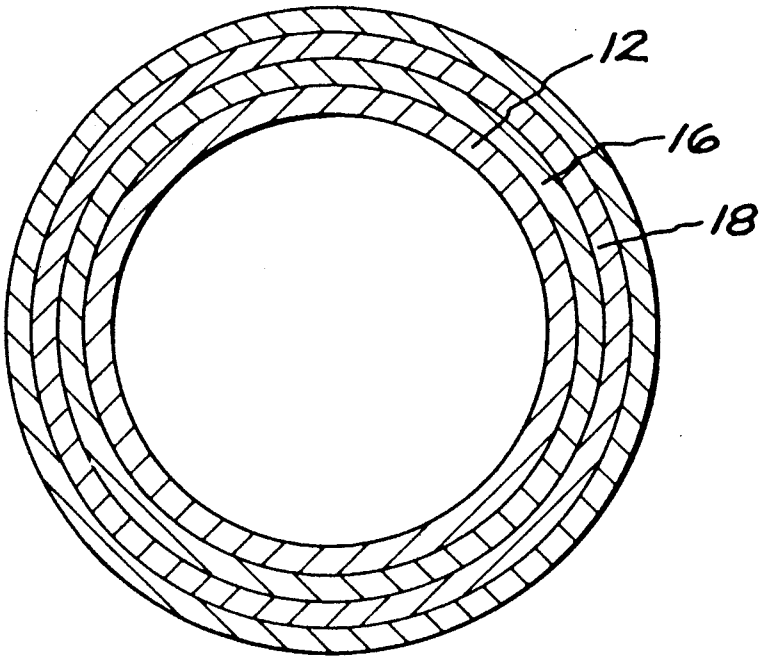
FIG. 4 is a sectional view of the structure of FIG. 3 after the HIPing is complete and the HIPing can and the mandrel shaft are removed.
Figure 3:
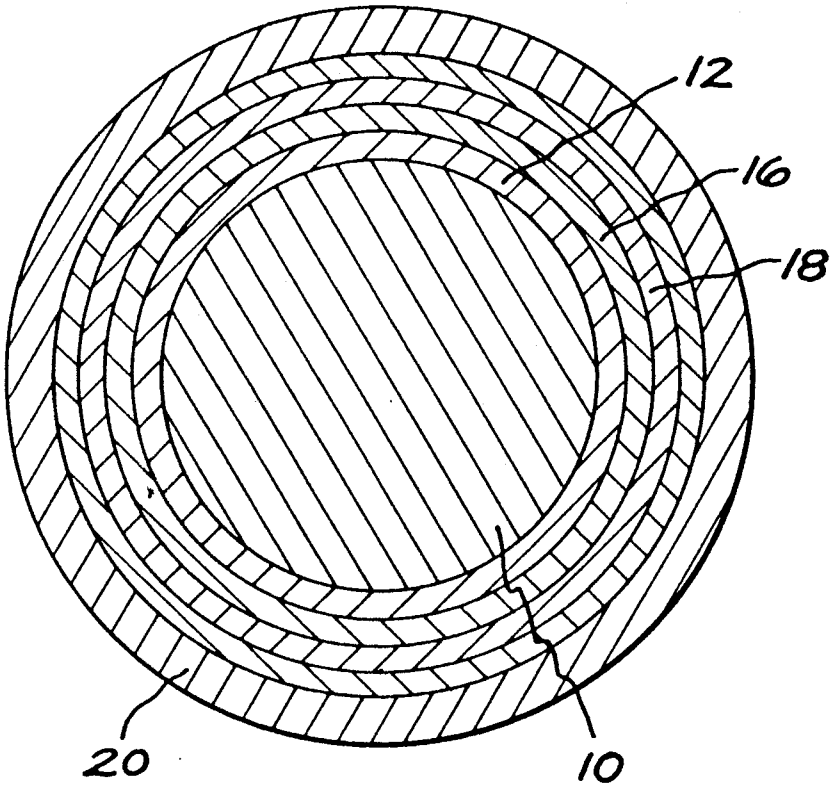
FIG. 3 is a cross section of a mandrel bearing several layers of monotape enclosed within a HIPing can prior a HIPing operation.

Successive layers of monotape are wound onto the shaft with each layer being disposed with a pitch opposite to that of the preceding layer until a desired number of layers of approximately 20 or 50 are wound onto the mandrel as illustrated in FIG. 3. FIGS. 3 and 4 are semischematic illustrations in which each layer is shown as a separate layer for clarity of illustration, although the separate layers disappear during the consolidation and do not appear as shown as separate layers in FIG. 4. Also the number of layers illustrated is limited for clarity of illustration as it would be very difficult to show 20 to 50 separate layers in FIG. 3. At this point, the structure is fitted within a HIPing can as illustrated in FIG. 3 and the entire structure is HIPed at a temperature of at least 800° C. and a pressure of at least 5 ksi for a period of over 30 minutes. Following the HIPing operation the mandrel and HIPing can are removed. What remains is a light weight but very strong filament reinforced hollow shaft article having a relatively high volume fraction of filament reinforcement of about 25–40 percent.

What is claimed is:

1. A method of forming a shaft of high strength and light weight which comprises:

providing a shaft-shaped mandrel, forming filament reinforced monotape by plasma spray depositing a metal matrix onto an aligned array of filament reinforcement on a substrate surface, removing the upper and less dense portion of the deposited matrix metal from the monotape, winding ribbons of the resulting monotape onto the shaft at an angle to the axis of the shaft, and consolidating the multilayer wound structure into a unified composite tubular shaft by HIPing.

2. The method of claim 1 in which the successive windings of monotape ribbon are set at an angle to the axis which is of opposite pitch to the preceding winding.

3. The method of claim 1 in which the proportion of the upper portion thickness of the deposited matrix which is removed is between 10 and 50 percent.

4. The method of claim 1 in which the proportion of the upper portion thickness of the deposited matrix which is removed is between 20 and 40 percent.

* * * * *